US011293130B2

(12) United States Patent
Promutico

(10) Patent No.: US 11,293,130 B2
(45) Date of Patent: Apr. 5, 2022

(54) HOUSEHOLD APPLIANCE WITH A SAFETY DEVICE TO PREVENT THE EXIT OF CLOTHS AND RELATED SAFETY DEVICE

(71) Applicant: BITRON S.P.A., Turin (IT)

(72) Inventor: Fabrizio Promutico, Turin (IT)

(73) Assignee: BITRON S.P.A., Turin (IT)

( * ) Notice: Subject to any disclaimer, the term of this patent is extended or adjusted under 35 U.S.C. 154(b) by 137 days.

(21) Appl. No.: 16/470,184

(22) PCT Filed: Jul. 13, 2017

(86) PCT No.: PCT/IT2017/000140
§ 371 (c)(1),
(2) Date: Jun. 14, 2019

(87) PCT Pub. No.: WO2018/109787
PCT Pub. Date: Jun. 21, 2018

(65) Prior Publication Data

US 2019/0309462 A1 Oct. 10, 2019

(30) Foreign Application Priority Data

Dec. 16, 2016 (IT) ..... 102016000127447

(51) Int. Cl.
*D06F 37/42* (2006.01)
*H01H 13/50* (2006.01)
(Continued)

(52) U.S. Cl.
CPC ..... *D06F 37/42* (2013.01); *E05B 15/004* (2013.01); *E05B 63/0017* (2013.01);
(Continued)

(58) Field of Classification Search
CPC ..... D06F 37/42
See application file for complete search history.

(56) References Cited

U.S. PATENT DOCUMENTS 7,775,070 B2 * 8/2010 Lim ..... E05C 19/02 68/12.26
2010/0066469 A1 3/2010 Sattler et al.
2010/0077803 A1 * 4/2010 Lim ..... D06F 37/42 68/212

FOREIGN PATENT DOCUMENTS

CN 205741631 U 11/2016
DE 10 2006 052428 A1 5/2008
(Continued)

OTHER PUBLICATIONS

International Search Report and Writen Opinion of the International Searching Authority for International Application No. PCT/IT2017/000140, dated Nov. 17, 2017, in 14 pages.
(Continued)

*Primary Examiner* — Jason Y Ko
(74) *Attorney, Agent, or Firm* — Knobbe, Martens, Olson & Bear, LLP

(57) ABSTRACT

The present invention concerns a household appliance (1), such as a washing machine and the like, comprising a chassis (11), a drum (12), for containing clothes (P), said drum (12) being contained in said chassis (11) and accessible through an opening (13), and a door (2), hinged to said chassis (11), for closing said opening (13), characterized in that it comprises a safety device (3) arranged to interact with said door (2) and configured to interrupt the operation of said household appliance (1) in case of said clothes (P) contained in said drum (12) exert a stress on said door (2) exceeding a safety threshold. The present invention also relates to a safety device (3) to prevent the exit of clothes (P) from a household appliance (1).

20 Claims, 2 Drawing Sheets

(51) Int. Cl.

| | |
|---|---|
| ***H01H 35/00*** | (2006.01) |
| ***E05B 63/00*** | (2006.01) |
| ***E05B 65/06*** | (2006.01) |
| ***E05B 15/00*** | (2006.01) |
| *D06F 39/14* | (2006.01) |
| *E05B 15/04* | (2006.01) |

(52) U.S. Cl.
CPC ..... *E05B 65/06* (2013.01); *H01H 13/50* (2013.01); *H01H 35/006* (2013.01); *D06F 39/14* (2013.01); *E05B 15/04* (2013.01)

(56) References Cited

FOREIGN PATENT DOCUMENTS

| | | | |
|---|---|---|---|
| EP | 2281937 | A2 | 2/2011 |
| EP | 2719811 | A1 | 4/2014 |
| JP | 11-235495 | A | 8/1999 |
| JP | 2014-018450 | A | 2/2014 |
| WO | WO 2014/013687 | A1 | 1/2014 |

OTHER PUBLICATIONS

Search Report for Italian Patent Application No. IT102016000127447, dated May 5, 2017, in 8 pages.

* cited by examiner

HOUSEHOLD APPLIANCE WITH A SAFETY DEVICE TO PREVENT THE EXIT OF CLOTHS AND RELATED SAFETY DEVICE

CROSS-REFERENCE TO RELATED APPLICATIONS

This application is the U.S. National Phase under 35 U.S.C. § 371 of International Application PCT/IT2017/000140, filed Jul. 13, 2017, which claims priority to IT Application No. 102016000127447, filed Dec. 16, 2016.

SUMMARY

The present invention concerns a household appliance with a safety device to prevent the exit of clothes and related safety device.

More specifically, the invention relates to a household appliance of said type, and in particular a washing machine, designed and realized to prevent the contents of the clothes from exit.

In the following, the description will be directed to a washing machine, but it is clear that the same should not be considered limited to this specific use.

As is well known, there are currently several types of commercial washing machines, both frontal and top load type.

During the washing, it has been verified that some clothes to be washed, in particular the so-called "bedding" clothes, i.e. duvets and blankets, may trap between the drum and the structure of the machine or the door, creating a trapping situation. Such a condition can also lead to the sudden opening of the door.

It is clear that household appliances according to the prior art are very risky, causing domestic accidents, and expensive for manufacturers, who have eventually to call back household appliances and put them in safe conditions.

In the light of the above, it is an object of the present invention to propose a device, which interrupts the operation of the washing machine or the household appliance in general, in case of the contained clothes trap between the drum and the door.

Another object of the invention is to propose a device that can also be installed on devices without such functionality.

It is therefore a specific object of the present invention a household appliance, such as a washing machine and the like, comprising a chassis, a drum, for containing clothes, said drum being contained in said chassis and accessible through an opening, and a door, hinged to said chassis, for closing said opening, characterized in that it comprises a safety device arranged to interact with said door and configured to interrupt the operation of said household appliance in case of said clothes contained in said drum exert a stress on said door exceeding a safety threshold.

Always according to the invention, said safety device could comprise a switch, directly or indirectly inserted in the power supply circuit of said household appliance, so that, when said switch is in a first state, said household appliance can normally operate, while when said switch is in a second state, said household appliance is not powered, a safety member, movable between a rest position, in which it is disengaged from said door, and an operating position, in which it is engaged with said door, said safety member being configured to cause the passage of said switch from said first state to said second state, a return member, as a spring and the like, fixed between said chassis and said slider, said safety member being configured such that, when it is in said operating position: if the stress of said clothes on said doors less than said safety threshold, said door in its turn stresses said slider, which is held in position by said return member; and if the stress of said clothes on said door is greater than said safety threshold, said door in its turn stresses said slider, which, overcoming the resistance of said return member, due to the passage of said switch from said first state to said second state, interrupting the power supply of said household appliance.

Still according to the invention, said safety member could comprise a slider.

Advantageously according to the invention, said slider, when it is stressed by said door, when the latter is in its turn stressed by said clothes, moves in a direction perpendicular to that it moves when it passes from said rest position to said operating position and vice versa.

Further according to the invention, when said switch could be in said first state, it is closed, while when said switch is in said second state, it is open.

Preferably according to the invention, said switch could comprise a diverter coupled with said safety member, so as to pass said switch from said first to said second state in case of a movement of said slider, as a result of the stress of said door by said clothes.

Always according to the invention, said device could comprise a control logic unit and said safety device could comprise an actuator operatively connected to said control logic unit, said actuator being adapted to move said safety member from said rest position to said operating position and vice versa, due to a control of said control logic unit.

Still according to the invention, said control logic unit could be programmed in such a way that, when said safety device interrupts the operation of said household appliance, it does not allow the reactivation of the same, unless a user manually carries out the activation.

Advantageously according to the invention, said door could have a recess, in which said safety member inserts when in said operating position.

Further according to the invention, said chassis could present a housing in which said safety device is housed, in correspondence of a portion of the perimeter of said opening.

It is further object of the present invention a safety device to prevent the exit of clothes from a household appliance, such as a washing machine and the like, said household appliance being of the type having a door, including a switch, directly or indirectly insertable in the power supply circuit of said household appliance, a safety member, movable between a rest position, in which it is disengaged from said door, and an operating position, in which it is engaged with said door, said safety member being configured to cause the passage of said switch from said first state to said second state, and a return member, such as a spring and the like, fixed between the chassis of said household appliance and said slider.

Always according to the invention, said safety member could comprise a slider.

BRIEF DESCRIPTION OF THE DRAWINGS

The present invention will be now described, for illustrative but not limitative purposes, according to its preferred embodiments, with particular reference to the figures of the enclosed drawings, wherein.

DETAILED DESCRIPTION

In the various figures, similar parts will be indicated by the same reference numbers.

Figure 1:
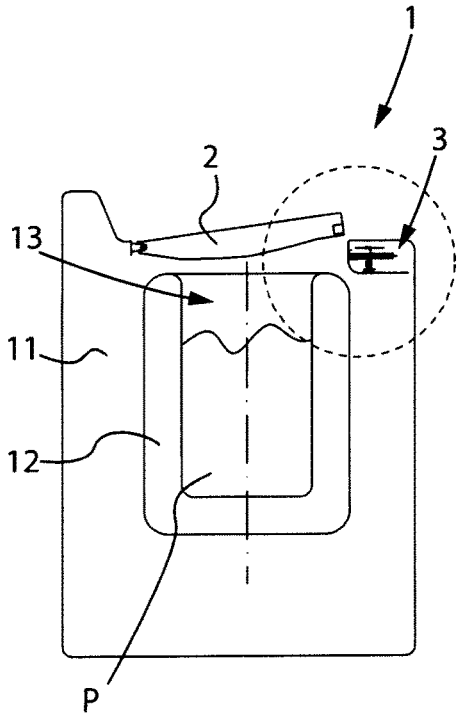
FIG. 1 shows a longitudinal sectional view of a top-load washing machine provided with a device for preventing the clothes to exit according to the present invention, in which the door is open.
Figure 2:
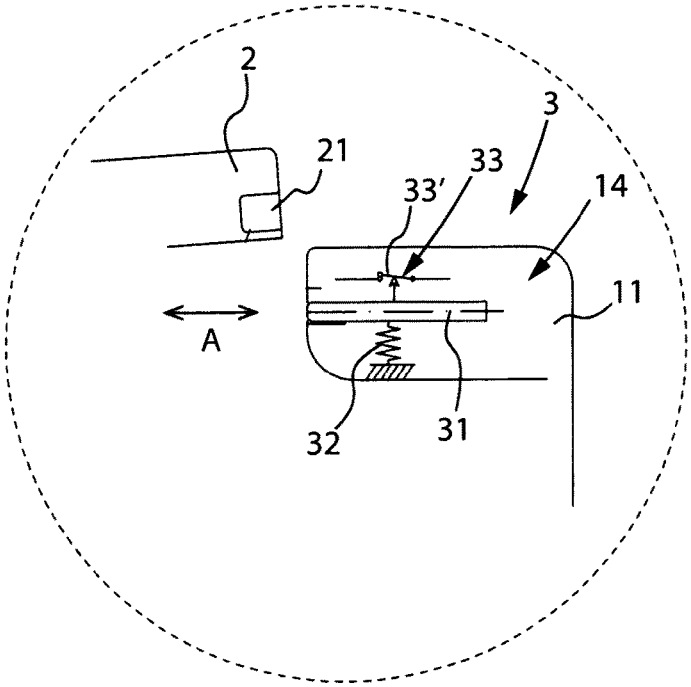
FIG. 2 shows a detail of FIG. 1.

Referring to FIGS. 1 and 2, it is seen a household appliance 1 with a safety system to prevent the clothes to exit.

The washing machine 1 essentially comprises a chassis 11, a drum 12, for holding the clothes P contained within said chassis 11, a door 2 hinged to said chassis 11 for closing an opening 13 for accessing the drum 12.

Said door 2 has a recess 21, whose function will be better defined below.

In addition, said chassis 11 has a housing 14 in correspondence with a portion of the perimeter of said opening 13, the function of which will be better defined in the following.

Said washing machine 1 also includes a safety device 3 to prevent the exit of the clothes P from the drum 12, while the washing machine 1 is operating.

Said safety device 3 is installed in said housing 14 and is capable of detecting any stress of said clothes on said drum 12.

Said device 3 comprises a slider 31 movable according to the arrow A between a rest position, in which it is disengaged from said recess 21, and an operating position, in which it is engaged with said recess 21.

The slider 31 is operated by a suitable actuator, not shown in the figures, controlled by a logic control unit of the washing machine 1 or the household appliance in general.

In particular, when the door 2 is closed and the washing machine 1 is operated by a user, said actuator moves said slider 31 from said rest position to said operating position and vice versa, when the washing machine 1 is deactivated.

Said safety device 3 also includes a return spring 32, fixed between said chassis 11 and said slider 31, and a switch 33 inserted directly or indirectly into the power supply circuit of said washing machine 1 or capable of generating a signal, so that, when said switch 33 is closed, said washing machine 1 can operate on a regular basis, while, when said switch 33 is open, said washing machine 1 is not power supplied, i.e., a signal is generated that is received by the logic control unit of the washing machine 1, inhibiting the operation.

The diverter 33' of said switch 33 is physically coupled to said slider 31, such that in case of a movement of said slider 31 in the direction of the arrow B, i.e. transversely to said arrow A.

The operation of the washing machine 1 described above, provided with the safety device 3, is as follows.

When said washing machine 1 operates on regular basis, drum 12 is loaded with clothes P and the door 2 is closed.

Figure 3:
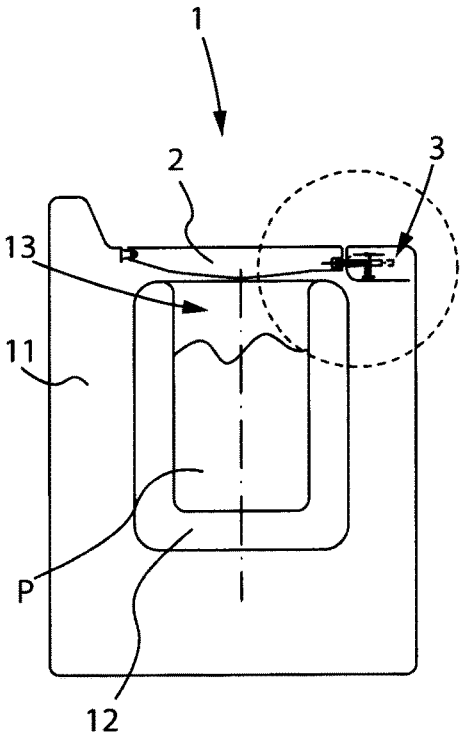
FIG. 3 shows a longitudinal sectional view of a washing machine according to FIG. 1 in which the door is closed.
Figure 4:
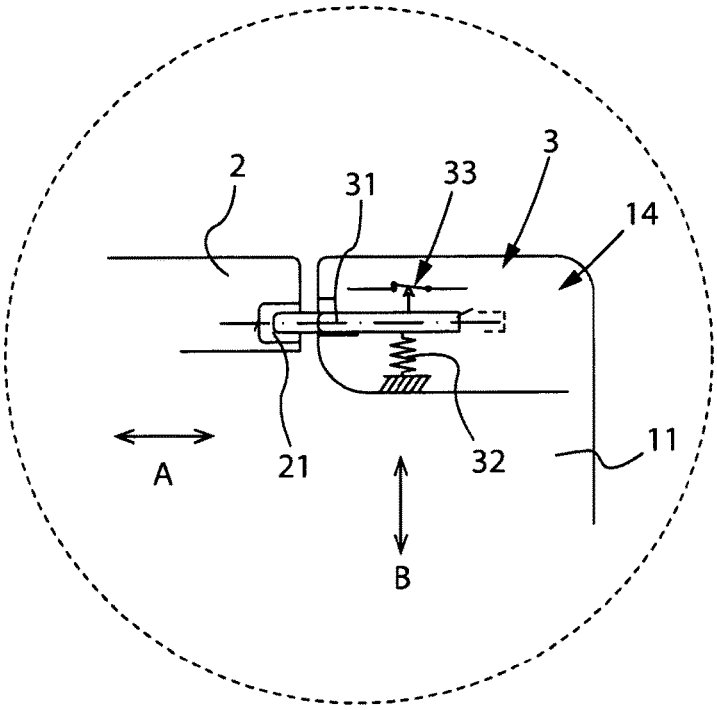
FIG. 4 shows a detail of FIG. 3.

When the washing machine 1 is operated, said actuator moves the slider 31 from said rest position to said operating position (see FIGS. 3 and 4), such that said slider 31 inserts in said recess 21 of said door 2.

In this configuration, the switch 33 is closed and, therefore, the washing machine 1 is power supplied.

If during the washing operations the clothes P contained within the drum 12 exert a moderate (and normal) pressure on the inner surface of said door 2, said door 2 would tend to raise the slider 31 upwards (with respect to the figure). The return spring 32 would, of course, tend to bring the slider back to its normal position.

Figure 5:
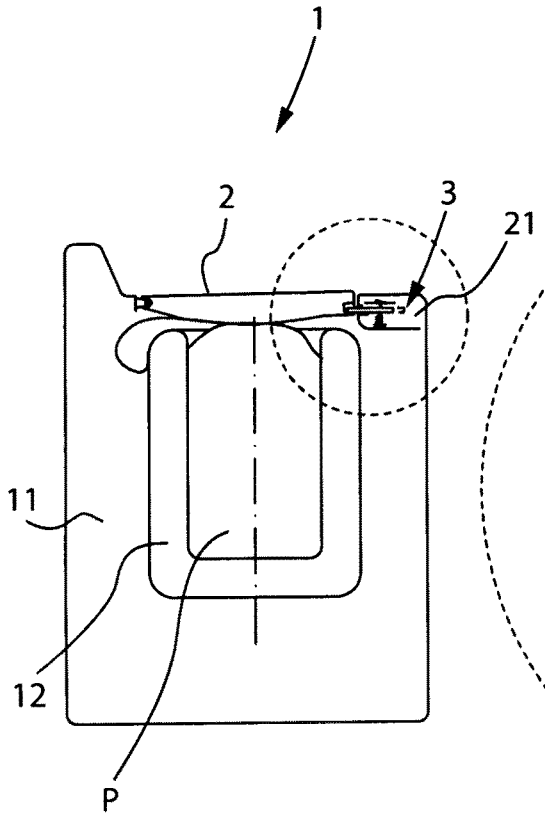
FIG. 5 shows a longitudinal sectional view of a washing machine according to FIG. 1, in which the door is closed and the contained clothes exert a mechanical stress on the door.
Figure 6:
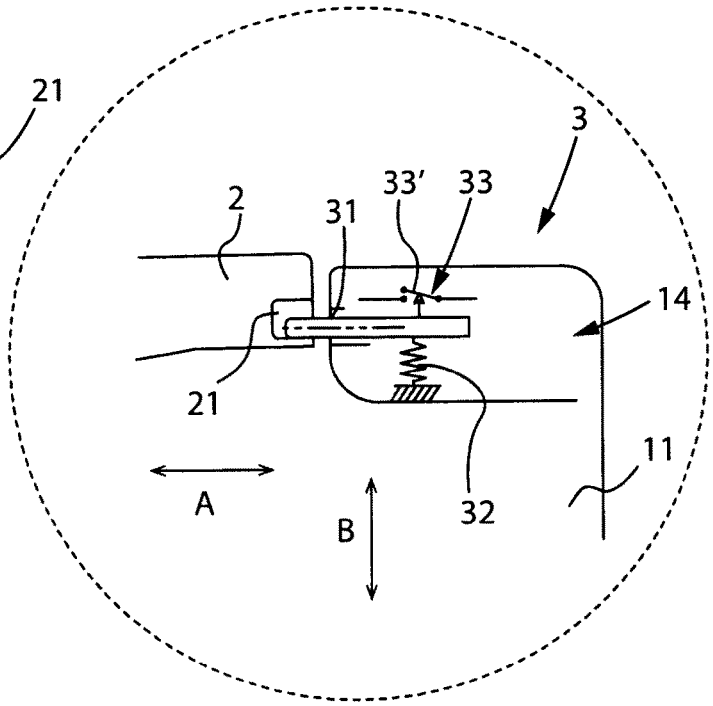
FIG. 6 shows a detail of FIG. 5.

If, on the other hand, when the clothes P contained within the drum 12 during the washing operations exert a mechanical stress on the door 2 beyond a specific threshold (as shown in FIG. 5), the door 2 would also raise upwards also the slider 31, since the latter would interfere with the recess 21, so as to overcomes the retorn force of said spring 32.

The slider 31, in this case, by means of the diverter 33', causes the opening of the switch 33, interrupting the power supplying of the washing machine 1. The logic control unit of the washing machine 1, even if immediately after the stress on the door 2 would be interrupted and the switch 33 would then close, it would not allow the reactivation of the washing machine 1 unless the user voluntarily activates it.

An advantage of the present invention is to prevent the clothes contained within a washing machine from causing excessive pressure on the door, causing the opening thereof, to increase the safety of the system.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A safety device to prevent the exit of clothes from a household appliance, wherein said household appliance comprises:

a chassis;

a drum for containing clothes, the drum being contained in said chassis and accessible through an opening; and a door, hinged to the chassis, for closing the opening, the door comprising a recess, wherein the safety device comprises a slider configured to insert into the recess of the door, wherein the safety device is arranged to interact with the door of the household appliance via the slider being inserted into the recess of the door, wherein the safety device is configured to interrupt the operation of the household appliance via a switch connected to the slider interrupting a power supply circuit of the household appliance with the clothes contained in the drum exerting a stress on the door exceeding a safety threshold and the door stressing the slider in the recess.

2. The safety device according to claim 1, wherein the switch is directly or indirectly insertable in the power supply circuit of the household appliance, so that, with said switch in a first state, the household appliance can normally operate, and with said switch in a second state, the household appliance is not powered;

further comprising:

a safety member, movable between a rest position, in which the safety member is disengaged from said door, and an operating position, in which the safety member is engaged with the door of the household appliance, wherein the safety member is configured to cause the passage of the switch from the first state to the second state, wherein said safety member comprises the slider; and a return member comprising a spring, wherein the return member is fixed between the chassis of the household appliance and the slider, wherein the safety member is configured such that, with the safety member in the operating position:

with the stress of the clothes on the door being less than said safety threshold, said slider is configured to be held in position by the return member; and with the stress of the clothes on the door being greater than the safety threshold, said door is configured to stress said slider, which, overcoming the resistance of the return member, due to the passage of the switch from said first state to said second state, is configured to interrupt the power supply circuit of said household appliance.

3. The safety device according to claim 1, wherein the household appliance comprises a washing machine.

4. The safety device according to claim 2, wherein the slider, with the slider stressed by said door with the door of the household appliance stressed by said clothes, is configured to move in a direction perpendicular to that the slider moves with the slider passing from the rest position to the operating position and vice versa.

5. The safety device according to claim 2, wherein with said switch in the first state, the switch is closed, and with said switch in the second state, the switch is open.

6. The safety device according to claim 5, wherein said switch comprises a diverter coupled with the safety member, so as to pass the switch from the first to the second state in case of a movement of the slider, as a result of the stress of the door of the household appliance by the clothes.

7. The safety device according to claim 2, wherein said safety member inserts in the recess of the door of the household appliance in said operating position.

8. The safety device according to claim 2, wherein the household appliance comprises a control logic unit, and wherein the safety device comprises an actuator operatively connected to the control logic unit of the household appliance, wherein the actuator is adapted to move said safety member from the rest position to the operating position and vice versa, due to a control of the control logic unit of the household appliance.

9. The safety device according to claim 1, wherein, when the safety device interrupts the operation of the household appliance, the safety device is configured not to allow the reactivation of the household appliance, unless a user manually carries out the activation.

10. The safety device according to claim 1, wherein the chassis of the household appliance comprises a housing, and wherein the safety device is housed in the housing of the chassis of the household appliance, the housing positioned at a portion of the perimeter of the opening.

11. A safety device to prevent the exit of clothes from a household appliance, wherein said household appliance comprises:

a chassis;

a drum for containing clothes, the drum being contained in said chassis and accessible through an opening; and a door, hinged to the chassis, for closing the opening, wherein the safety device comprises a protrusion configured to engage the door, wherein the safety device is arranged to interact with the door of the household appliance via the protrusion engaging the door, wherein the safety device is configured to interrupt the operation of the household appliance via a switch connected to the protrusion interrupting a power supply circuit of the household appliance with the clothes contained in the drum exerting a stress on the door exceeding a safety threshold and the door stressing the protrusion engaging the door.

12. The safety device according to claim 11, wherein the switch is directly or indirectly insertable in the power supply circuit of the household appliance, so that, with said switch in a first state, the household appliance can normally operate, and with said switch in a second state, the household appliance is not powered;

further comprising:

a safety member, movable between a rest position, in which the safety member is disengaged from said door, and an operating position, in which the safety member is engaged with the door of the household appliance, wherein the safety member is configured to cause the passage of the switch from the first state to the second state, wherein said safety member comprises a slider, the slider comprising the protrusion; and a return member comprising a spring, wherein the return member is fixed between the chassis of the household appliance and the slider, wherein the safety member is configured such that, with the safety member in the operating position:

with the stress of the clothes on the door being less than said safety threshold, said slider is configured to be held in position by the return member; and with the stress of the clothes on the door being greater than the safety threshold, said door is configured to stress said slider, which, overcoming the resistance of the return member, due to the passage of the switch from said first state to said second state, is configured to interrupt the power supply circuit of said household appliance.

13. The safety device according to claim 12, wherein the slider, with the slider stressed by said door with the door of the household appliance stressed by said clothes, is configured to move in a direction perpendicular to that the slider moves with the slider passing from the rest position to the operating position and vice versa.

14. The safety device according to claim 12, wherein with said switch in the first state, the switch is closed, and with said switch in the second state, the switch is open.

15. The safety device according to claim 14, wherein said switch comprises a diverter coupled with the safety member, so as to pass the switch from the first to the second state in case of a movement of the slider, as a result of the stress of the door of the household appliance by the clothes.

16. The safety device according to claim 12, wherein the door of the household appliance comprises a recess, and wherein said safety member inserts in the recess of the door of the household appliance in said operating position.

17. The safety device according to claim 12, wherein the household appliance comprises a control logic unit, and wherein the safety device comprises an actuator operatively connected to the control logic unit of the household appliance, wherein the actuator is adapted to move said safety member from the rest position to the operating position and vice versa, due to a control of the control logic unit of the household appliance.

18. The safety device according to claim 11, wherein the household appliance comprises a washing machine.

19. The safety device according to claim 11, wherein, when the safety device interrupts the operation of the household appliance, the safety device is configured not to allow the reactivation of the household appliance, unless a user manually carries out the activation.

20. The safety device according to claim 11, wherein the chassis of the household appliance comprises a housing, and wherein the safety device is housed in the housing of the chassis of the household appliance, the housing positioned at a portion of the perimeter of the opening.

* * * * *